US005125595A

United States Patent [19]

Helton

[11] Patent Number: 5,125,595

[45] Date of Patent: Jun. 30, 1992

[54] DIGITAL IMAGE STABILIZATION SYSTEM FOR STRAPDOWN MISSILE GUIDANCE

[76] Inventor: Monte K. Helton, 1012 Arnold Rd., Madison, Ala. 35758

[21] Appl. No.: 656,923

[22] Filed: Feb. 15, 1991

[51] Int. Cl.[5] ..... F41G 7/22

[52] U.S. Cl. ..... 244/3.16

[58] Field of Search ..... 244/3.16, 3.15

[56] References Cited

U.S. PATENT DOCUMENTS

H455 4/1988 Helton ..... 244/3.15

4,637,571 1/1987 Holder et al. ..... 244/3.16

*Primary Examiner*—Charles T. Jordan

[57] ABSTRACT

A digital image processor is used in conjunction with an articulate sensor to achieve electronic stabilization of a target image, thereby avoiding the large field of view requirement which is a common and fundamental limitation of current technology strapdown missile guidance system.

4 Claims, 2 Drawing Sheets

DIGITAL IMAGE STABILIZATION SYSTEM FOR STRAPDOWN MISSILE GUIDANCE

DEDICATORY CLAUSE

The invention described herein may be manufactured, used, and licensed by or for the Government for governmental purposes without the payment to me of any royalties thereon.

BACKGROUND OF THE INVENTION

A strapdown missile guidance system involves a target-sensing device that is physically attached to the missile so that it is stabilized with respect to missile body motion rather than with respect to an inertial reference. A fundamental drawback of the current strapdown missile guidance system, however, is the requirement that the field of view of the sensor be large enough to accommodate various missile maneuvers during flight without losing the target from the field of view. The large field of view requirement, in turn, limits the sensor resolution such that target can be recognized only at very close ranges.

SUMMARY OF THE INVENTION

The invention described below is a strapdown missile guidance system which avoids the large field of view requirement by using an electronic image stabilization technique in conjunction with an articulated sensor.

DESCRIPTION OF THE PREFERRED EMBODIMENT

Figure 1:
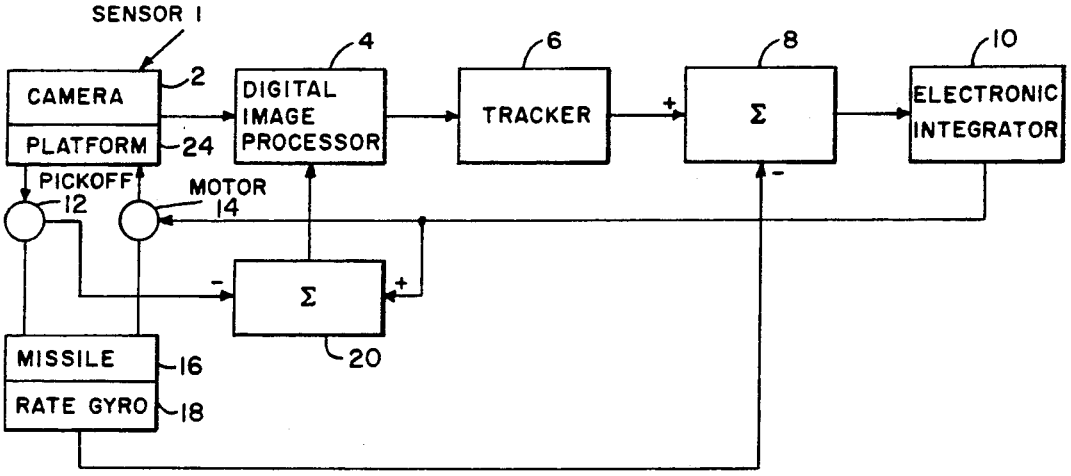
FIG. 1 is a block diagram of the preferred embodiment of the invention.

Referring now to the drawings wherein like numbers refer to like parts, FIG. 1 is a block diagram of the preferred embodiment of the invention.

Sensor 1, being comprised of camera 2 and platform 24, is mounted on missile 16 and is partially stabilized with respect to the missile body motion so that the image of target is maintained within plus or minus 50% of the sensor field of view at all times during the missile flight. This image maintenance is achieved by attaching camera 2 fixedly to platform 24 and by making the platform itself articulate with respect to the various orientation of missile 16 during its flight. A pick-off device 12, typically a potentiometer, appropriately positioned between sensor 1 and missile 16 constantly measures the angle between the missile and the sensor, and produces angular data and rate gyro 18, suitably located with respect to missile 16 measures the rate of the motion of missile 16 and produces rate output.

Camera 2 produces videodata output in response to target position it senses, and this videodata is input to digital image processor 4 which performs pan and scroll function to move the image up, down or sideways in response to signals received from an external source and produces analog videodata output of the target image (analog-to-digital and vice versa conversions are discussed elsewhere in this Description). The analog output is, then, input to tracker 6 which, in turn, produces DC signals that are indicative of the target position within the field of view of sensor 1. Summing device 8 combines the DC signals and the electrical reverse of the rate output of rate gyro 18 and inputs the result of the summation to electronic integrator 10 which, then, produces an electronic gimbal angle in response to input thereto. The electronic gimbal angle is the electrical equivalent of the platform gimbal angle with respect to missile 16 in a classical rate-stabilized seeker. The electronic gimbal angle, in the instant invention, is then input to motor 14, located between sensor 1 and missile 16, which causes sensor 1 to move with respect to missile 16 in accordance with the electronic gimbal angle. If the sensor control loop responds with sufficient alacrity, then sensor 1 will assume a position with respect to the missile, which position is equal to the electronic gimbal angle and the sensor will, in effect, be rate-stabilized based on the performance of rate gyro 18. However, when the sensor control loop is not precise, the difference between the actual sensor angle with respect to missile 16, i.e. angular data from pick-off 12, and the electronic gimbal angle can be used to drive digital image processor 4 and thereby fully stabilize the sensor output. The difference between angular data and electronic gimbal angle is obtained by summing device 20 which sums the electronic gimbal angle output of electronic integrator 10 and the electrical reverse of angular data from pick-off 12 and produces, from the summation, signals which are then input to the synchronizer of processor 4 to enable the processor to perform the pan-and-scroll function. Therefore, if the measured missile body rate is equal to the actual missile body rate and the measured camera angle position is equal to the actual camera position then the seeker output is the desired measure of the target inertial line of sight rate. Here, the term "seeker" includes sensor 1, digital image processor 4, tracker 6, electronic integrator 10 and summing devices 8 and 20.

The accuracy of the operation of the instant invention depends on the accuracy of rate gyro 18, the accuracy of pick-off 12 and the accuracy and time lag of digital image processor 4 and electronic integrator 10. When these accuracy conditions are satisfied, the dynamics of the sensor position control loop do not affect the seeker output. The digital image processor is driven by the error signal of the sensor position control loop. That is, when $\Omega = \beta - \theta_c$, m, where $\Omega$ = the result of the summation occurring at summing device 20 of electronic gimbal angle and the electrical reverse of angular data $\beta$ = electronic gimbal angle, $\theta_c$m = sensor position with respect to missile 16, the only requirement of the positioning loop is to control $\Omega$ to the extent required to keep the magnitude of $\Omega$ within the field of view of sensor 1. The digital image processor can stabilize the target image in the center of the field of view through excursions of slightly less than plus or minus 50% of the field of view, depending on target gate size. A reasonable requirement on the camera positioning loop is to maintain $\Omega$ to within plus or minus 25% of the sensor field of view. The digital image processor can then correct for the camera error and still accommodate plus or minus 25% of missile motion about this error range. Maintaining $\Omega$ to within plus or minus 25% of the sensor field of view is achievable with a non-precision gimbal set.

Figure 2:
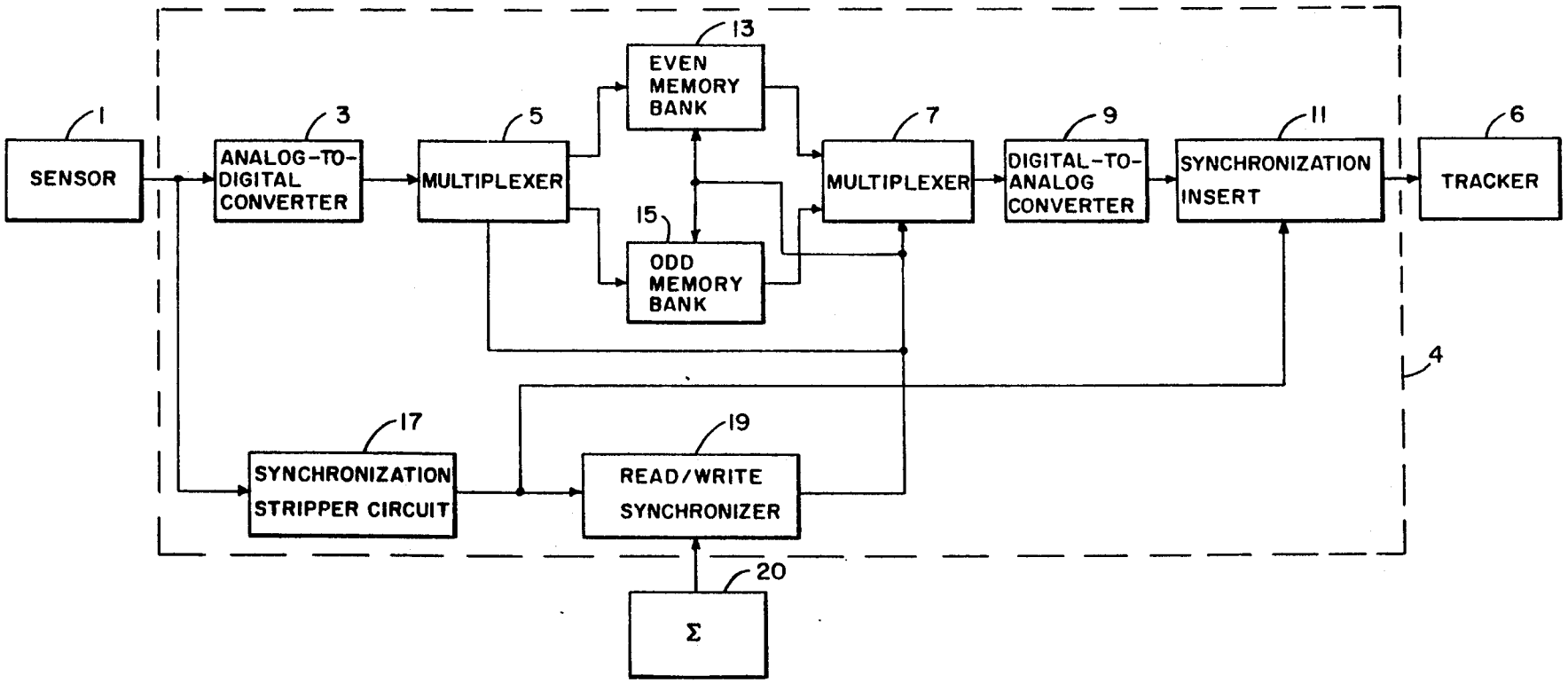
FIG. 2 is a detailed block diagram of the digital image processor.

FIG. 2 is a detailed block diagram of digital image processor 4 (henceforth, referred to as DIP). The DIP is a device which accepts a standard RS-170 analog video input. In instant invention, the video input is from sensor 1. The incoming video is converted to digital format by analog-to-digital converter 3, and video synchronizing signals are extracted from the video input by synchronization stripper circuit 17. The digitized video is then stored in a frame buffer comprised of an even field memory 13 and an odd field memory 15. The input multiplexer 5 and output multiplexer 7 control memory input/output so that when the even field memory is being written into, the odd field memory is being read out and vice versa. Each memory field consists of 240 rows of 512 addresses each so that, at the proper digitizing rate, each incoming line of video will be digitized into 512 pixels which are stored in one row of memory. Thus 240 rows will accommodate one field of video, having 240 active lines. The read/write synchronizer 19 controls the memory read/write address. The memory write address is controlled with respect to the incoming video synchronization signal from synchronization stripper circuit 17 such that there is an exact correspondence between the row, column address of the memory write address and the pixel row, column location in the video field. The memory read address, however, can be modified in response to an input from summing device 20. By advancing or delaying the row, read address with respect to the video synchronization signal from circuit 17, the image can be made to move up or down, respectively. Similarly, by advancing or delaying the starting column address of each row in a field, the image can be shifted to the right or left. The output of multiplexer 7 is then reconverted to an analog signal stream by digital-to-analog converter 9 and the synchronization signal is reinserted by synchronization inserter 11 to produce an RS-170 analog output video signal in a shifted state.

In the instant invention, digital-to-analog reconversion of videodata was necessary because the available tracker required an analog input. However, if a tracker requiring a digital video input were used, then digital-to-analog converter 9 could be eliminated.

As a result of having gone through DIP, the videodata from sensor 1 is time-delayed by one video field time and a portion of the video image is lost, the lost portion corresponding to the amount of image shift.

The articulated sensor with electronic image stabilization is an attractive alternative to a classical rate-stabilized platform for a link-controlled missile. A link-controlled missile is defined as a missile from which sensor information is down-linked to a remote control station, usually manned by a human operator, where the sensor data is processed by a tracking device to compute control signals for both sensor pointing and missile guidance. The control signals are then up-linked to the missile to complete the overall closed loop control. In such an application the digital image processor as well as the tracker are located on the ground and not on the missile. The only requirement on the missile is to supply camera video, a means to measure missile-camera angle, and missile rate information. Stabilization of the video is then accomplished on the ground. Control commands for articulated camera sent back to the missile complete the stabilization loop.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

I claim:

1. A strapdown missile guidance system, comprising: a sensor for sensing a target position and producing first videodata output in response thereto, said sensor being suitably mounted on a missile; a digital image processor, said processor being appropriately positioned for receiving said first videodata output from said sensor and producing second videodata output; a tracker, said tracker being coupled to said processor for receiving said second videodata output therefrom and producing signals descriptive of target position; a rate gyro, said gyro being appropriately aligned to measure missile body rate and produce rate output in response thereto; a first summation means, said first summation means being coupled in parallel to said tracker and said gyro and being suitable for summing said signals and said rate output and producing a result therefrom; measurement means suitably positioned for measuring the angle between said sensor and the missile and producing angular data; feedback means coupled to said sensor for controlling the look angle of said sensor; an electronic integrator, said integrator being coupled to said first summation means for receiving said result therefrom and producing an electronic gimbal angle in response thereto, said integrator being further coupled to said feedback means for inputting said electronic gimbal angle to said feedback means; and second summation means, said second summation means being coupled in parallel to said measurement means and said integrator for receiving and summing said angular data from said measurement means and said electronic gimbal angle from said integrator and producing, from the summation, commanding signals, said second summation means being further coupled to said image processor for inputting said commanding signals to said processor thereby enabling said processor to stabilize said first videodata output from said sensor.

2. A missile guidance system as described in claim 1, wherein said feedback means is a position adjustor for adjusting the position of said sensor with respect to the missile in response to said electronic gimbal angle.

3. A missile guidance system as described in claim 2, wherein said sensor further comprises a movable platform and a camera, said camera being mounted on said platform and said platform being coupled to said feedback means.

4. A strapdown missile guidance system as described in claim 3 wherein said measurement means is a potentiometer.

* * * * *